US008777732B2

(12) United States Patent
Robbins et al.

(10) Patent No.: US 8,777,732 B2
(45) Date of Patent: Jul. 15, 2014

(54) GAME PLAY WHILE IN QUEUE FOR ENTRY INTO AN EVENT

(71) Applicant: WMS Gaming, Inc., Waukegan, IL (US)

(72) Inventors: Richard B. Robbins, Glenview, IL (US); Mary Griffin, London (GB); Andrew C. Guinn, Chicago, IL (US); Harry C. Lang, London (GB); Travis N. Nelson, Canton, GA (US)

(73) Assignee: WMS Gaming, Inc., Waukegan, IL (US)

( * ) Notice: Subject to any disclaimer, the term of this patent is extended or adjusted under 35 U.S.C. 154(b) by 0 days.

(21) Appl. No.: 13/679,914

(22) Filed: Nov. 16, 2012

(65) Prior Publication Data

US 2013/0130786 A1 May 23, 2013

Related U.S. Application Data

(60) Provisional application No. 61/561,371, filed on Nov. 18, 2011.

(51) Int. Cl.
*G07F 17/00* (2006.01)
*G07F 19/00* (2006.01)

(52) U.S. Cl.
USPC ..... 463/25; 463/1; 463/29

(58) Field of Classification Search
USPC ..... 463/1, 16–20, 25, 29–31, 40–43; 379/266.01, 266.03
See application file for complete search history.

(56) References Cited

U.S. PATENT DOCUMENTS

| | | | | |
|---|---|---|---|---|
| 5,502,806 | A * | 3/1996 | Mahoney et al. | 715/839 |
| 5,718,632 | A | 2/1998 | Hayashi | |
| 7,050,569 | B1 * | 5/2006 | Weaver et al. | 379/266.01 |
| 7,231,035 | B2 * | 6/2007 | Walker et al. | 379/266.01 |
| 8,095,400 | B2 * | 1/2012 | Herde et al. | 705/5 |
| 8,589,819 | B2 * | 11/2013 | Allen | 715/810 |
| 2002/0147647 | A1 * | 10/2002 | Ragsdale-Elliott et al. | 705/15 |
| 2003/0014749 | A1 * | 1/2003 | Simons et al. | 725/23 |
| 2003/0103619 | A1 * | 6/2003 | Brown et al. | 379/266.01 |
| 2003/0108185 | A1 * | 6/2003 | Brown et al. | 379/266.01 |

(Continued)

FOREIGN PATENT DOCUMENTS

GB 2491270 11/2012

OTHER PUBLICATIONS

U.S. Appl. No. 13/479,237, filed May 23, 2012, Andrew, C G., et al.

(Continued)

*Primary Examiner* — Milap Shah
(74) *Attorney, Agent, or Firm* — DeLizio Gilliam, PLLC

(57) ABSTRACT

A method includes receiving a request for placement in a queue for entry into an event. The method also includes placing the request into the queue. In response to placement of the request into the queue, the method includes presenting, on a device, a game for game play while waiting for the entry into the event. The device comprises at least one of a mobile device, a pager provided in response to requesting the placement in the queue, and a non-mobile gaming device positioned proximate to a location of the event. The method includes determining a prize for the game play of the game. In response to not entering the event, the prize is discarded. In response to entering the event, the prize is awarded.

28 Claims, 10 Drawing Sheets

(56) References Cited

U.S. PATENT DOCUMENTS

| | | | | |
|---|---|---|---|---|
| 2003/0177017 | A1* | 9/2003 | Boyer et al. | 705/1 |
| 2005/0200455 | A1* | 9/2005 | Veni et al. | 340/7.55 |
| 2007/0173330 | A1* | 7/2007 | Crawford et al. | 463/42 |
| 2007/0173331 | A1* | 7/2007 | Crawford et al. | 463/42 |
| 2007/0191107 | A1 | 8/2007 | Walker et al. | |
| 2008/0045335 | A1* | 2/2008 | Garbow et al. | 463/29 |
| 2008/0260138 | A1* | 10/2008 | Chen et al. | 379/215.01 |
| 2009/0093300 | A1* | 4/2009 | Lutnick et al. | 463/26 |
| 2009/0239660 | A1 | 9/2009 | Acres | |
| 2009/0280909 | A1* | 11/2009 | McEniry | 463/42 |
| 2011/0143832 | A1 | 6/2011 | Walker et al. | |
| 2011/0275438 | A9 | 11/2011 | Hardy et al. | |
| 2011/0307547 | A1* | 12/2011 | Backer et al. | 709/203 |
| 2012/0302324 | A1 | 11/2012 | Guinn et al. | |

OTHER PUBLICATIONS

"UK Application GB1209321.7 Examination Report", Sep. 24, 2012, 4 pages.

* cited by examiner

GAME PLAY WHILE IN QUEUE FOR ENTRY INTO AN EVENT

RELATED APPLICATIONS

This application claims the priority benefit of U.S. Provisional Application Ser. No. 61/561,371 filed Nov. 18, 2011.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2012, WMS Gaming, Inc.

FIELD

Embodiments of the inventive subject matter relate generally to game play, and more particularly to game play while in a queue for entry into an event.

BACKGROUND

There are many situations where people are placed into queues for entry into an event. For example, a person can be placed into a queue for entry into a poker game at a wagering game establishment. In another example, a person can be placed into a queue for entry into a restaurant, a club, an amusement park ride, an airplane, ticket counters for purchasing tickets, etc.

BRIEF DESCRIPTION OF THE FIGURES

Embodiments of the invention are illustrated in the Figures of the accompanying drawings in which.

DESCRIPTION OF THE EMBODIMENTS

This description of the embodiments is divided into six sections. The first section provides an introduction to some example embodiments, while the second section provides a system environment and example system applications. The third section describes example operations performed by some example embodiments. The fourth section describes an example wagering game machine architecture. The fifth section describes an example wagering game machine and the sixth section presents some general comments.

Introduction

This section provides an introduction to some example embodiments. Some example embodiments provide for game play by the persons waiting in a queue for entry into an event. The game play can be performed on any of a number of different mobile and non-mobile gaming devices. For example, persons can play a game on their own mobile device. In another example, event personnel can give the persons a pager (a mobile device) that enables game play and notification of when the person is allowed entry into the event. In another example, non-mobile gaming devices (e.g., wagering game machines) are positioned near the event to allow for game play by persons in the queue. The games can be games of chance (e.g., electronic scratch cards), games of skill, or games involving elements of both chance and skill (e.g., poker). If game play results in a win, the person can be awarded a prize. Examples of events include restaurants, wagering games (both table games and games on wagering game machines), a club, an amusement park ride, an airplane ride, ticket counter for purchasing tickets, etc.

System Environment and Example System Applications

Figure 3:
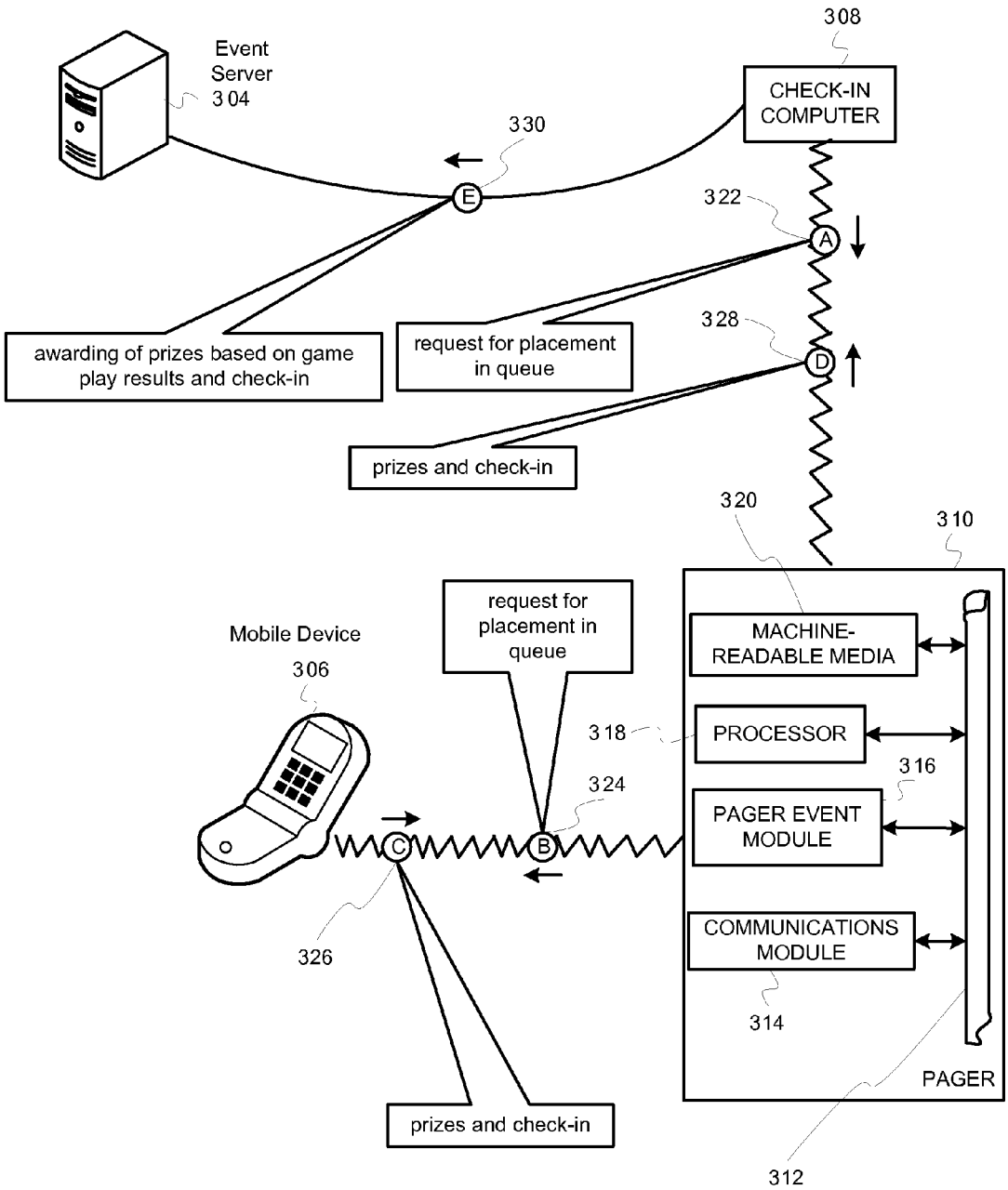
FIG. 3 depicts a more detailed block diagram and communications between a pager and a mobile device for game play while in a queue for entry into an event, according to some example embodiments.
Figure 4:
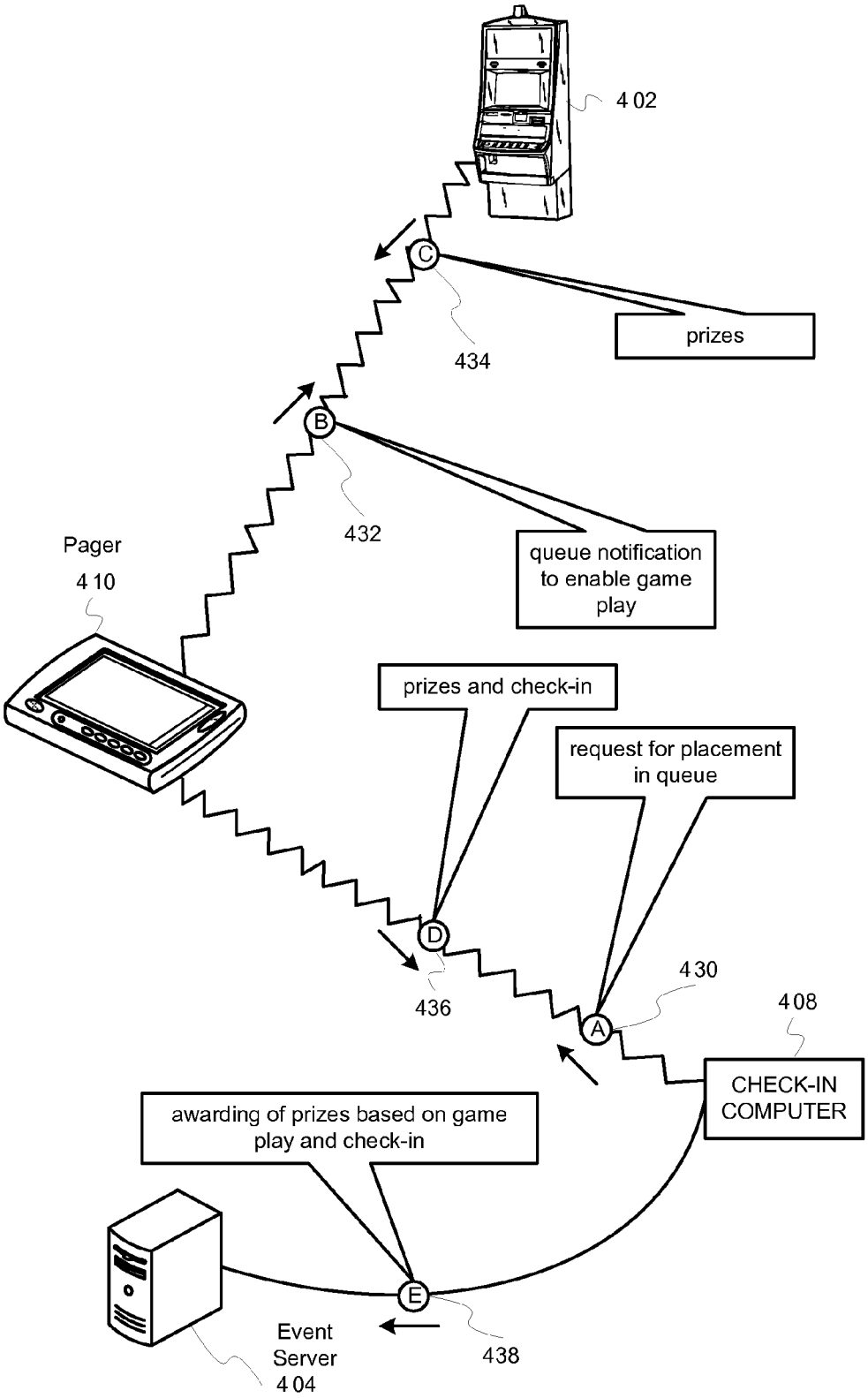
FIG. 4 depicts a more detailed block diagram and communications between a pager and a non-mobile gaming device for game play while in a queue for entry into an event, according to some example embodiments.
Figure 5:
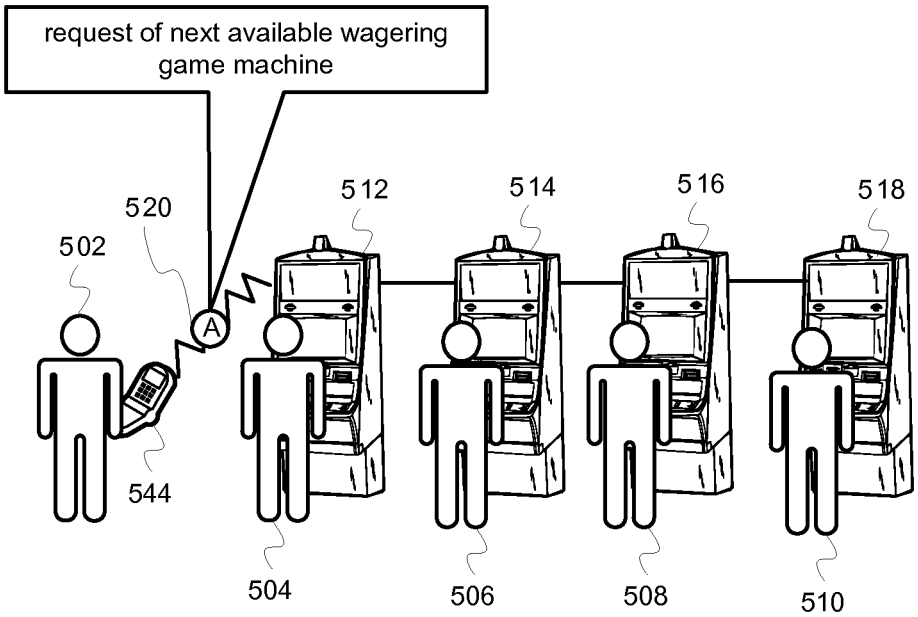
FIG. 5 depicts communications between a mobile device and a group of wagering game machines (currently occupied by others) for play of one of the wagering game machines, according to some example embodiments.

This section describes an example system environment and example system applications and presents structural aspects of some example embodiments. This section includes an example system and some different example applications of game play while waiting in a queue for entry into an event. This section will discuss FIGS. 1-5. The discussion of FIG. 1 will describe a system that provides game play while waiting in a queue for entry into an event. The discussion of FIGS. 2-5 will describe different example applications that provide game play while waiting in a queue for entry into an event. In particular, FIG. 2 will describe a part of the system and some example communications that provide game play while waiting in a queue for entry into an event. FIG. 3 will describe a part of the system (that includes a mobile device and a pager) and some example communications that provide game play while waiting in a queue for entry into an event. FIG. 4 will describe a part of the system (that includes a non-mobile gaming device and a pager) and some example communications that provide game play while waiting in a queue for entry into an event. FIG. 5 will describe a part of the system (that includes non-mobile gaming devices and a mobile device) and some example communications that provide game play while waiting in a queue for playing at one of the non-mobile gaming devices.

Figure 1:
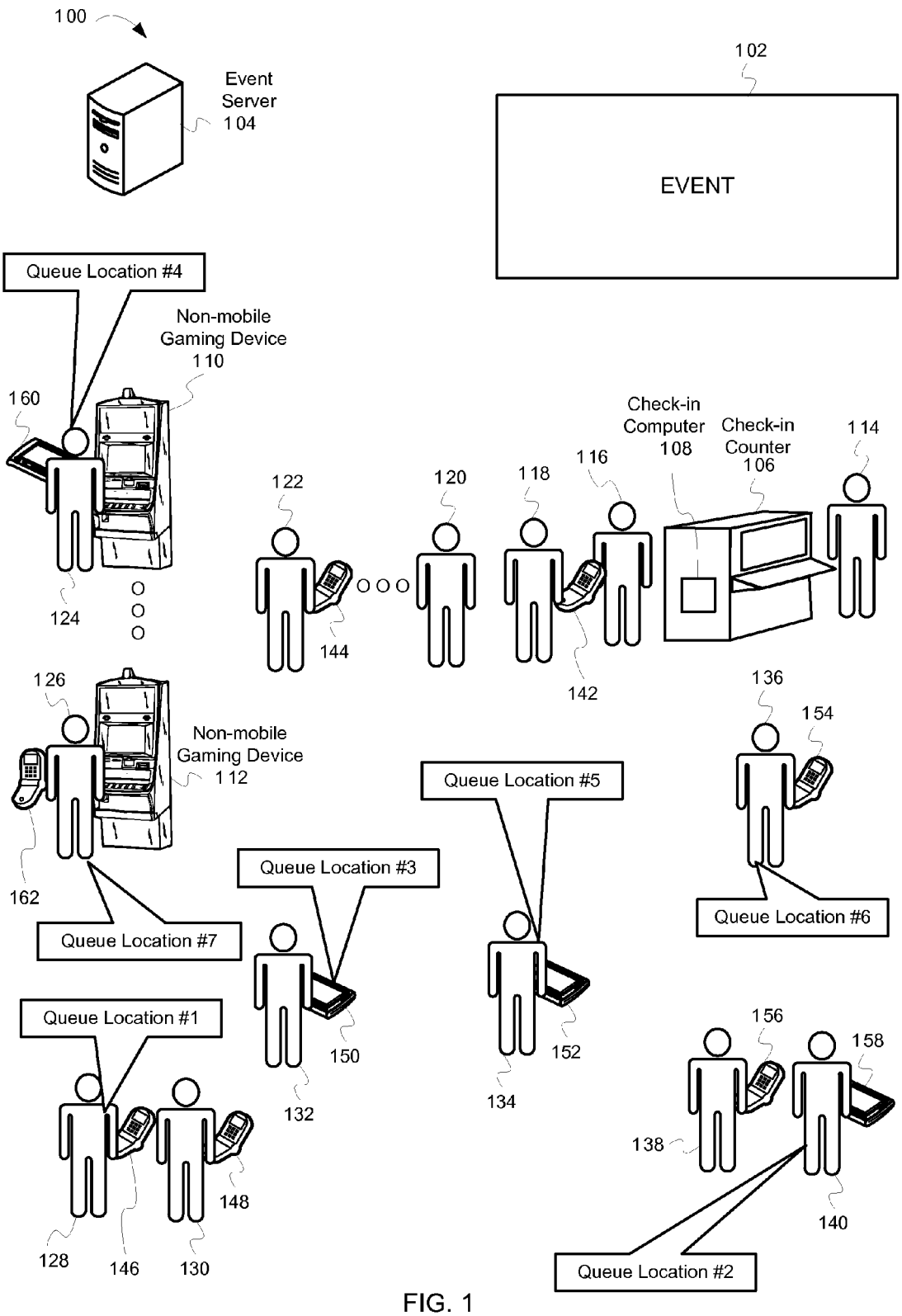
FIG. 1 depicts a system for game play while in a queue for entry into an event, according to some example embodiments.

FIG. 1 depicts a system for game play while in a queue for entry into an event, according to some example embodiments. An event can comprise any occasion that can include a queue to allow entry of persons therein. A system 100 includes an event 102, an event server 104, and a check-in counter 106 (that includes a check-in computer 108). Although not shown, the event server 104 and the check-in computer 108 can be communicatively coupled together. The system 100 also includes a number of non-mobile gaming devices (shown as non-mobile gaming devices 110-112). The non-mobile gaming devices 110-112 can include different types of wagering game machines (e.g., slot machine, video poker, etc.). The non-mobile gaming devices 110-112 can be communicatively coupled to the event server 104 and the check-in computer 108. Event personnel 114 is positioned at the check-in counter 106 to manage the placing of persons into a queue for entry into the event 102, for allowing persons entry into the event 102, etc.

Also, a number of persons are waiting for entry into the event 102. The number of persons are in two groups. A first group of persons includes persons that already are in the queue for entry into the event. A second group of persons includes persons that are waiting in line for entry into the queue. The first group of persons includes a person 128 and a person 130 that share a queue location #1; a person 138 and a person 140 that share a queue location #2; a person 132 that has a queue location #3; a person 124 that has a queue location #4; a person 134 that has a queue location #5; a person 136 that has a queue location #6; and a person 126 that has a queue location #7. The second group of persons includes a person 116, a person 118, a person 120, and a person 122.

The persons in the first group are playing games on a number of different devices while waiting in the queue for entry into the event 102. The devices where games can be played can include a person's own mobile device, a pager that is provided by event personnel that provides notification of time to enter the event 102, and a non-mobile gaming device. The game play can result in different types of prizes if wins occur. Some of these persons are playing games on their own mobile devices (e.g., cell phone, smartphone, etc.). The person 128 is playing a game on their mobile device 146; the person 130 is playing a game on their mobile device 148; the person 136 is playing on their mobile device 154; and the person 138 is playing on their mobile device 156. The person 132 is playing a game on a pager 150; the person 134 is playing a game on a pager 152; and the person 140 is playing on a pager 158. The person 124 is playing a game on the non-mobile gaming device 110; and the person 126 is playing a game on the non-mobile gaming device 112. Also, the person 124 has a pager 160; and the person 126 has their mobile device 162.

The persons in the second group are waiting in line for placement in the queue for entry into the event 102. These persons may or may not have their own mobile devices. Also, during check-in at the check-in counter 106 for placement in the queue, the persons may or may not receive a pager for notification for time to enter the event 102. For example, instead of being notified by an event-issued pager, persons can be notified by the mobile devices, verbal communications from event personnel, etc. In this example, the person 118 has their mobile device 142; and the person 122 has their mobile device 144.

As further described below, the check-in computer 108 can include a communications module that enables wireless communication (e.g., Near Field Communications, Bluetooth, etc.) with the mobile devices of the persons or pagers assigned to the persons. In some example embodiments, the person is provided with an expected wait time in the queue when the placement in the queue occurs. The check-in computer 108 can store this value for a given person. Also, the check-in computer 108 can provide this value to at least one of the mobile device and the pager for the person the placement in the queue. If the expected wait time in the queue is exceeded, the person is provided an additional prize or better prizes as a result of the wins in the game play.

Also, such wireless communication can be used to place the person into the queue; check the person into the event 102; and download the game onto the mobile device or pager (if necessary) from the check-in computer 108. Also, in some example embodiments, any prizes provided during game play are only awarded to the person after they check-in to the event and/or actually complete attending the event. For example, assume that the event 102 is a restaurant and the prizes relate to the current visit to the restaurant. The person is given the prizes after they check-in for seating at the restaurant based on communications between the check-in computer 108 and the mobile device or pager of the person. In such an example, the person can place their mobile device or pager in proximity to the check-in location to enable the device to wireless communicate receipt of the check-in. The person can be provided the prizes based on this wireless communication. In another example, assume that the event 102 is a restaurant and the prizes relate to a subsequent visit to the restaurant; loyalty points to an account, etc. The person can be given the prizes from the game play after they pay their bill for the current restaurant visit. Accordingly through game play, some example embodiments incentivize the persons to remain in the queue to attend the event 102.

The pagers can include logic to enable the pager to wireless communicate with a person's mobile device. Such wireless communication can allow for the download of a game to a person's mobile device; communication to indicate that check-in is complete for prize redemption, etc. In some example embodiments, the pager can be configured to allow for game play thereon. Accordingly, a person is not required to have their own mobile device for game play. This pager can be used to wireless communicate with a non-mobile gaming device (e.g., a wagering game machine). For example, the person 124 can play the non-mobile gaming device 110. Once the person is notified of a time to enter the event, the person can discontinue game play. The non-mobile gaming device 110 can wirelessly communicate (e.g., Near Field Communications, Bluetooth, etc.) with the pager 160 about the prizes won. Once the person 124 returns the pager 160 at the check-in counter 106, the pager 160 can communicate the prizes won to the check-in computer 108. The prizes can then be awarded to the person 124 (e.g., a player account updated with the prizes won). For example, the check-in computer 108 can send a transmission to the apparatus server 104 to update a player account for the person 124 with the prizes. For example, the person 124 can be awarded double loyalty points to their player account during their time in the queue for the wagering game play. If the time in the queue exceeded a certain threshold, the person 124 can be awarded triple loyalty points to their player account during their time in the queue for the wagering game play. Such loyalty points can be redeemed for prizes, unlocked content for a wagering game machine at a later time, etc.

The event 102 can also be a table game (e.g., poker, blackjack, etc.) at a wagering game establishment. If the tables are full, a person can be placed into the queue and allowed to play an electronic version of the same game (for which they are waiting) at one of the non-mobile gaming devices 110-112. In this example, the prizes can include loyalty points and/or chips to be used at the table game. Such prizes can depend on the length of the wait in the queue, the amount of money spent during play of the electronic version, how well the person performed in the electronic version, etc.

The prizes can be part of a loyalty program for the brand where the event is located. For example, assume that the event is within a wagering game establishment. The prizes can be related to a points program for a wagering game account for game play at that wagering game establishment. In some example embodiments, the game is related to the event. For example, if the event is a poker game at a wagering game establishment, the game can be a poker game.

In another example, the game can be a themed electronic scratch card, wherein the theme is associated with the brand of the event, type of event, etc. As an example, the person can be presented with an electronic scratch card every X minutes (e.g., 2 minutes, 5 minutes, etc.) that the person is in the queue. Additionally, a prize from the game play can be tied to the current event (the event 102) or different event at a later time. For example, if the event is a restaurant, a prize from game play can be a free drink, 10% discount of the meal, etc. for the current or upcoming event.

In some example embodiments, the prizes from game play dynamically vary based on the anticipated wait time in the queue (e.g., the longer the anticipated wait, the larger the rewards). The prizes can also vary based on the wait time in the queue. For example, the longer time a person is in the queue, the greater the prize can be. The length of a given game or type of game can dynamically vary based on the anticipated wait time in the queue. For example, if the anticipated wait time in the queue is considered long, the game presented has a longer completion time.

In some example embodiments, games are not available unless a threshold number of persons are in the queue (e.g., three, five, ten, etc.). In some example embodiments, a prize is awarded for being in the queue and the value of that prize varies based on game play of the game. For example, a person can be awarded a prize of 10% coupon for being in the queue. The person can play a slot machine, wherein the prize increases (20%) if the person receives winning results from a number of spins and the prize decreases (5%) if the person does not receive winning results from a number of spins.

In some example embodiments, the event can include an online wagering game, wherein persons are placed into the queue to enter the online wagering game. Also, where the event is part of a physical location (e.g., restaurant), the game that is presented can be part of an online gaming web site. In such an example, the person can be awarded prizes that include free loyalty points that are part of the online gaming web site (that can be used for redemption of prizes, unlocking of content for wagering game machines (online or at a brick-and-mortar wagering game establishment), etc.). Prizes for waiting in the queue and entering the event can include unlocked content for an online wagering game web site or at a brick-and-mortar wagering game establishment. For example, the unlocked content can include a wagering game or feature of a wagering game that is not yet generally available to the public. In some example embodiments, the game played while waiting in the queue comprises a wagering game on an online wagering game web site that is not yet generally available to the public. Accordingly, the prizes can be an incentive for waiting and a reward that is a result of waiting.

In some example embodiments, persons are awarded prizes for time waiting overages. These prizes can be based on the anticipated time to be in the queue that can be determined when the person enters the queue. Also, these prizes can vary depending on length of time the person is anticipated to wait for actual wait time. For example, the prizes can increase by multipliers as this time waiting overage grows (e.g., 2× for 15 minutes, 3× for 30 minutes, etc.). Also, the prizes awarded for time waiting overages can be in addition to the other prizes described for being in a queue. Such prizes can include modifications to the experience or rules related to the queue. For example, assume that the person is waiting in line for tickets and the limit for the number of tickets is 6 for a given person in line. The prize awarded for the time waiting overage is an increase in the limit (e.g., from 6 to 12 tickets). In another example, the prize for time waiting overages can include a discount dynamically applied to the ensuing purchase that is part of the event (e.g., 10% of the dinner event).

In some example embodiments, persons in the queue can opt-in to playing a game, wherein they risk their position in the queue based on game play. Accordingly, the winner of the game play would be given the highest position in the queue of those that opted in; the person in second place of the game play would be given the second highest position in the queue of those that opted in; etc. In some example embodiments, the event personnel can leave certain positions open in the queue that are filled by winners of the games. For example, if there is a cancellation, that position in the queue would be filled by a winner of the game among those persons in the queue that are playing. In some example embodiments, people can purchase those open positions in the queue. This can be through an auctioning or a straight purchase.

In some example embodiments, those persons that opt-in to a game can all be given some lesser prize, while only one person wins the grand prize. For example, all players that opt-in to play a game will be given a free drink during their meal, free airline miles, etc., while the winning player is given an available position in the queue that is better than where they are currently. In some example embodiments, the size of the prize for opting in is dependent on the person's position in the queue. For example, if the person is in the first 10 positions, the opt-in prize is 100 airline miles; if the person is in a lower position in the queue, the opt-in prize is 50 miles.

In some example embodiments, persons in the queue can auction and bid for positions in the queue of other persons. Such auctioning can be independent of involvement of the event beyond the placing of persons in the queue. Once in the queue, persons can auction their position to people within the queue or outside the queue. Such buying and selling of positions can occur using any of a number of electronic transfers (e.g., PayPal) using their mobile devices. In some example embodiments, the persons in the queue can wager their queue position (e.g., poker) using their mobile device.

In another example, assume that the event is a poker table. The game played while in the queue can include a poker game that simulates the players currently playing at the poker table. Such an embodiment allows the person (practice or play for real money) waiting to play at the poker table with players that simulate the actual players' behavior patterns at the physical table from which they are waiting to play.

Persons can be awarded different prizes for subsequent entry into a queue for the event at a later time. For example, if the person comes to a restaurant a second and later time and is placed into the queue, the person is awarded a better prize relative to the prize from the first visit at the restaurant. As an example, the person can be awarded additional content that is part of an episodic wagering game machine (e.g., unlocking of subsequent episodes). In some example embodiments, if a person enters multiple queues (e.g., two) in a given time period (e.g., one week) for a same or different event and attends the events, the person is awarded a prize that is in addition to any prizes for game play while in the queue.

In some example embodiments, the system algorithmically adjusts prizes for waiting based on the person's behavior. For example, the system can record past behavior of persons being in a particular queue. Such past behavior can include abandonment of a restaurant queue at given intervals of time for given locations. The system can then adjust the prizes accordingly to retain the customers. For example, the system can notify the persons that prizes are increasing at certain times at given locations where persons typically abandon the restaurant queue.

Also, the queues can vary in complexity and length. For example, the queues need not be linear. For example, there can be multiple lines for an event, wherein the different lines or branches represent different status levels for each related queue. Examples of events for such queues can include boarding of an aircraft, waiting in line to purchase season/concert tickets, etc.

Figure 2:
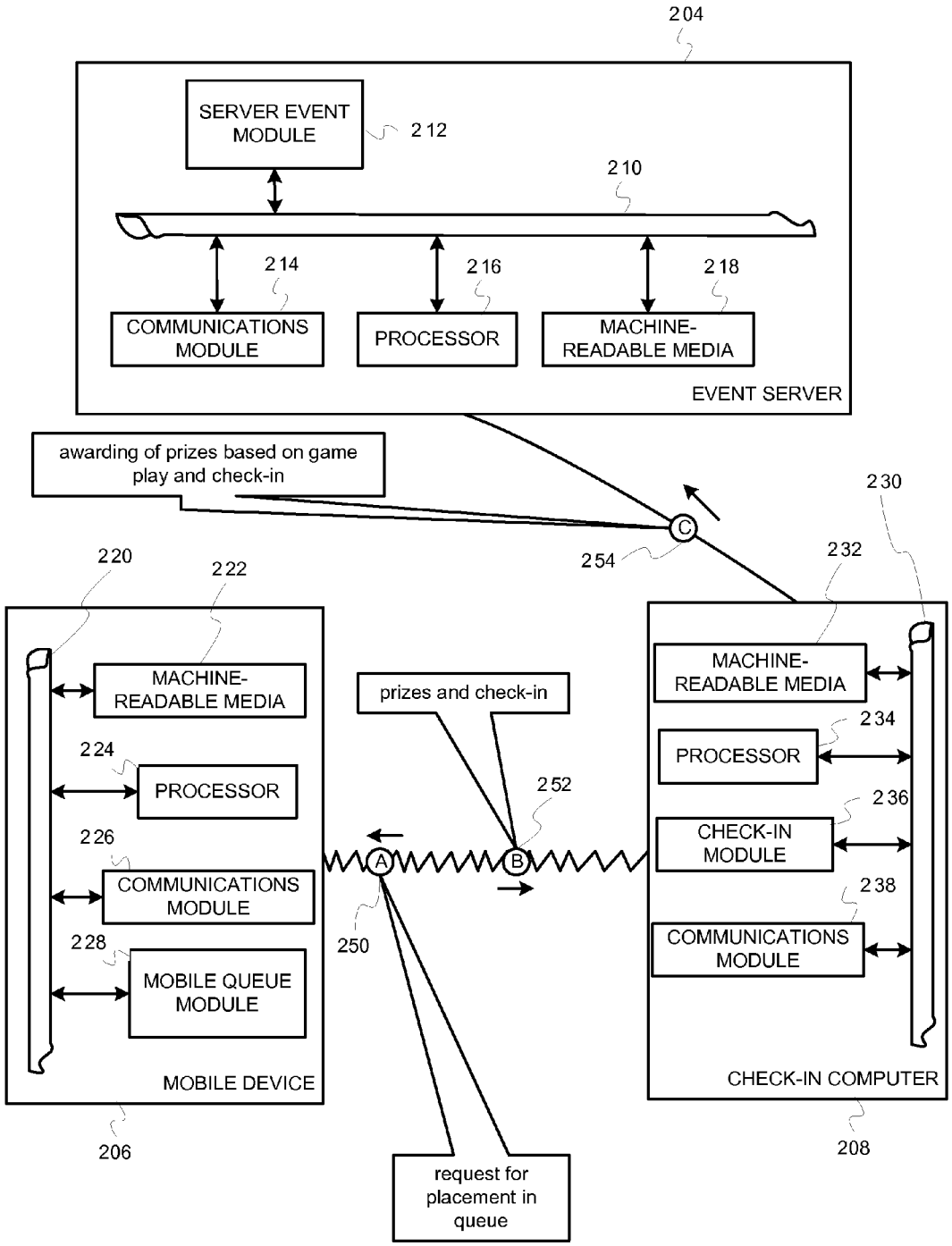
FIG. 2 depicts a more detailed block diagram of some components of the system and communications there between for game play while in a queue for entry into an event for awarding of the prizes, according to some example embodiments.

FIG. 2 depicts a more detailed block diagram of some components of the system and communications there between for game play while in a queue for entry into an event for awarding of the prizes, according to some example embodiments. In particular, FIG. 2 depicts communications between an event server 204, a mobile device 206, and a check-in computer 208 that provides game play and awarding of prizes won while waiting in a queue for entry in an event, according to some example embodiments. Also, FIG. 2 depicts more detailed block diagrams of the event server 204, the mobile device 206, and the check-in computer 208, according to some example embodiments. These detailed block diagrams can be representative of the event server 104, any of the mobile devices, and the check-in computer 108 of FIG. 1.

The event server 204 is communicatively coupled to the check-in computer 208 (e.g., wired communication and/or wireless communication). The check-in computer 208 is communicatively coupled to the mobile device 206 (e.g., wired communication and/or wireless communication). Although not shown, the event server 204 can also be communicatively coupled to the mobile device 206.

The event server 204 includes a server event module 212, a communications module 214, a processor 216, and a machine-readable media 218 that are communicatively coupled together through a communications bus 210. The server event module 212 can be hardware, software, firmware or a combination thereof for performing operations related to placement in the queue and awarding of prizes based on game play. For example, the server event module 212 can be software that is executing on the processor 216. The machine-readable media 218 can be non-volatile machine-readable media, volatile machine-readable media or a combination thereof. The machine-readable media 218 can be used for storage related to persons in a queue, the awarding of prizes won during game play based on an actual check-in to an event, etc. The communications module 214 can be hardware, software, firmware or a combination thereof for communications with external devices (e.g., the check-in computer 208).

The check-in computer 208 includes a check-in module 236, a communications module 238, a processor 234, and a machine-readable media 232 that are communicatively coupled together through a communications bus 230. The check-in module 236 can be hardware, software, firmware or a combination thereof for performing operations related to placement in the queue and awarding of prizes based on game play. For example, the check-in module 236 can be software that is executing on the processor 234. The machine-readable media 232 can be non-volatile machine-readable media, volatile machine-readable media or a combination thereof. The machine-readable media 232 can be used for storage related to persons in a queue, the awarding of prizes won during game play based on an actual check-in to an event, etc. The communications module 238 can be hardware, software, firmware or a combination thereof for communications with external devices (e.g., the event server 204 and the mobile device 206).

The mobile device 206 includes a mobile queue module 228, a communications module 226, a processor 224, and a machine-readable media 222 that are communicatively coupled together through a communications bus 220. The mobile queue module 228 can be hardware, software, firmware or a combination thereof for performing operations related to placement in the queue and awarding of prizes based on game play. For example, the mobile queue module 228 can be software that is executing on the processor 224. The machine-readable media 222 can be non-volatile machine-readable media, volatile machine-readable media or a combination thereof. The machine-readable media 232 can be used for storage of game play results, indication of placement in the queue, etc. The communications module 226 can be hardware, software, firmware or a combination thereof for communications with external devices (e.g., the check-in computer 208).

FIG. 2 also depicts a number of example communications among the mobile device 206, the check-in computer 208, and the event server 204 to provide for game play while waiting in a queue for entry into an event and the awarding of prizes won based on the game play. The check-in computer 208 transmits a communication A 250 to the mobile device 206. The communication A 250 can indicate that the person who owns the mobile device 206 was placed in the queue. For example, event personnel can input the placement in the queue into an input of the check-in computer 208 at a check-in counter for an event (see FIG. 1). In response, the check-in module 236 can transmit the communication A 250 to the mobile device 206 to indicate placement in the queue. The communication A 250 can also include a download of a game that can be played while waiting, a hyperlink to a website where a game can be played while waiting; an identification of the games (locally stored on the machine-readable media 222 and playable on the mobile device 206; playable on non-mobile gaming devices near the event; etc.) that can be played while waiting; etc.

The person of the mobile device 206 can then play a game at their mobile device 206 or some non-mobile gaming device, while waiting for entry into the event. During game play, the person can be awarded different prizes. Identification of these prizes can be stored in the machine-readable media 222. In some example embodiments, these prizes are not given to the person until after they check-in to the event and/or actually complete attending the event.

At some later time, the person is notified that they are now allowed entry into the event. This can be through verbal communication with an event personnel, a communication transmitted from the check-in computer 208 to the mobile device 206, a notification through a pager issued by the event personnel at the time of the placement in the queue, etc. The person then returns to the check-in counter. At this point, the mobile device 206 can transmit a communication B 252 to the check-in computer 208. The communication B 252 can be initiated based on a request for information by the check-in computer 208 after an event personnel inputs to the check-in computer 208 that the person is checked in. In response, the mobile device 206 can transmit the communication B 252 that can include identification of prizes won during game play and confirmation of check-in. In particular, the person that owns the mobile device 206 can verify through input on the mobile device 206 to transmit this communication.

After check-in of the person, the prizes can be awarded to the person. In some example embodiments, this awarding of the prizes is performed based on a communication C 254 being transmitted from the check-in computer 208 to the event server 204. The communication C 254 can include identification of the person, prizes won, and an indication that a check-in has occurred. The server event module 212 can process the communication C 254. For example, the server event module 212 can update loyalty points for a player account for the person; issue a coupon (e.g., 10%) related to the event, etc. The coupon can be electronically issued to an account associated with the person or a physical ticket can be output and presented to the person.

Another example of communications for game play while waiting in a queue for entry into an event which includes both a pager and a mobile device is now described. Accordingly, in this example instead of communications between the check-in computer and the person's mobile device, there are communications between a pager (provided by event personnel as part of placement in the queue) and the check-in computer and the pager and the person's mobile device. In particular, FIG. 3 depicts a more detailed block diagram and communications between a pager and a mobile device for game play while in a queue for entry into an event, according to some example embodiments. FIG. 3 depicts communications between an event server 304, a mobile device 306, a check-in computer 308, and a pager 310 that provides game play and awarding of prizes won while waiting in a queue for entry in an event, according to some example embodiments. The event server 304 can include the components illustrated by the event server 204 of FIG. 2. The check-in computer 308 can include the components illustrated by the check-in computer 208 of FIG. 2. The mobile device 306 can include the components illustrated by the mobile device 206 of FIG. 2. Also, FIG. 3 depicts more detailed block diagrams of the pager 310. The detailed block diagram of the pager 310 can be representative of the pagers of FIG. 1.

The event server 304 is communicatively coupled to the check-in computer 308 (e.g., wired communication and/or wireless communication). The check-in computer 308 is communicatively coupled to the pager 310 (e.g., wired communication and/or wireless communication). The pager 310 is communicatively coupled to the mobile device 306 (e.g., wired communication and/or wireless communication). Although not shown, each of the components of FIG. 3 can be communicatively coupled together. For example, the event server 304 can also be communicatively coupled to the mobile device 306 or the pager 310.

The pager 310 includes a pager event module 316, a communications module 314, a processor 318, and a machine-readable media 320 that are communicatively coupled together through a communications bus 312. The pager event module 316 can be hardware, software, firmware or a combination thereof for performing operations related to placement in the queue and awarding of prizes based on game play. For example, the pager event module 316 can be software that is executing on the processor 318. The machine-readable media 320 can be non-volatile machine-readable media, volatile machine-readable media or a combination thereof. The machine-readable media 320 can be used for storage of games, data related to persons in a queue, data related to the awarding of prizes won during game play based on an actual check-in to an event, etc. The communications module 314 can be hardware, software, firmware or a combination thereof for communications with external devices (e.g., the check-in computer 308).

FIG. 3 also depicts a number of example communications among the pager 310, the mobile device 306, the check-in computer 308, and the event server 304 to provide for game play while waiting in a queue for entry into an event and the awarding of prizes won based on the game play. In this example, a pager issued by event personnel is integrated into the communications to enable the game play and prize awarding. The check-in computer 308 transmits a communication A 322 to the pager 310. Event personnel can provide the pager 310 to the person at the check-in counter when placed in the queue. At this point, the person is within a queue for entry into an event. The communication A 322 can indicate that there was a placement in the queue. For example, event personnel can input the placement in the queue into an input of the check-in computer 308 at a check-in counter for an event (see FIG. 1). In response, the check-in module can transmit the communication A 322 to the pager 310 to indicate placement in the queue. The communication A 322 can also include a download of a game that can be played while waiting, a hyperlink to a website where a game can be played while waiting; an identification of the games (locally stored on the machine-readable media 322 and playable on the pager 310 or the mobile device 306; playable on non-mobile gaming devices near the event; etc.) that can be played while waiting; etc.

The pager 310 can then transmit a communication B 324 to the mobile device 306 of the person that is placed in the queue. The communication B 324 can indicate that the person who owns the mobile device 306 is placed in the queue. The communication B 324 can also include a download of a game that can be played while waiting, a hyperlink to a website where a game can be played while waiting; an identification of the games (locally stored on the machine-readable media and playable on the mobile device 306; playable on non-mobile gaming devices near the event; etc.) that can be played while waiting; etc.

The person of the mobile device 306 can then play a game at their mobile device 306 or some non-mobile gaming device, while waiting for entry into the event. During game play, the person can be awarded different prizes. Identification of these prizes can be stored in the machine-readable media. In some example embodiments, these prizes are not given to the person until after they check-in to the event and/or actually complete attending the event. In some other example embodiments, a person can play a game on the pager 310 instead of the mobile device 306.

At some later time, the person is notified that they are now allowed entry into the event. This can be through verbal communication by event personnel, a communication transmitted from the check-in computer 208 to the pager 310 or the mobile device 306, etc. The person then returns to the check-in counter. Also in response to ending game play, the mobile device 306 can transmit a communication C 326 to the pager 310. The communication C 326 can include identification of prizes won during game play and confirmation of check-in. In particular, the person that owns the mobile device 306 can verify through input on the mobile device 306 to transmit this communication.

Once the person returns to the check-in counter, the pager 310 can transmit a communication D 328 back to the check-in computer 308. The communication D 328 can be initiated based on a request for information by the check-in computer 308 after event personnel inputs to the check-in computer 308 that the person is checked in. In response, the pager 310 can transmit the communication D 328 that can include identification of prizes won during game play and confirmation of check-in.

After check-in of the person, the prizes can be awarded to the person. In some example embodiments, this awarding of the prizes is performed based on a communication E 330 being transmitted from the check-in computer 308 to the event server 304. The communication E 330 can include identification of the person, prizes won, and an indication that a check-in has occurred. The server event module in the event server 304 can process the communication E 330. For example, the server event module can update loyalty points for a player account for the person; issue a coupon (e.g., 10%) related to the event, etc. The coupon can be electronically issued to an account associated with the person or a physical ticket can be output and presented to the person.

Another example of communications for game play while waiting in a queue for entry into an event which includes both a pager and a non-mobile gaming device is now described. Accordingly, in this example instead of game play on a person's mobile device or event-issued pager, the game play occurs on a non-mobile gaming device. In this example, the non-mobile gaming device is a wagering game machine. In particular, FIG. 4 depicts a more detailed block diagram and communications between a pager and a non-mobile gaming device for game play while in a queue for entry into an event, according to some example embodiments.

FIG. 4 depicts communications between an event server 404, a check-in computer 408, a pager 410, and a wagering game machine 402 that provides game play and awarding of prizes won while waiting in a queue for entry in an event, according to some example embodiments. The event server 404 can include the components illustrated by the event server 204 of FIG. 2. The check-in computer 408 can include the components illustrated by the check-in computer 208 of FIG. 2. The pager 410 can include the components illustrated by the mobile device 310 of FIG. 3. Also, FIG. 9 (described below) depicts an example of a more detailed block diagram of the wagering game machine 402.

The event server 404 is communicatively coupled to the check-in computer 408 (e.g., wired communication and/or wireless communication). The check-in computer 408 is communicatively coupled to the pager 410 (e.g., wired communication and/or wireless communication). The pager 410 is communicatively coupled to the wagering game machine 402 (e.g., wired communication and/or wireless communication). Although not shown, each of the components of FIG. 4 can be communicatively coupled together. For example, the event server 404 can also be communicatively coupled to the mobile device the pager 310 and the wagering game machine 402.

FIG. 4 also depicts a number of example communications among the pager 410, the wagering game machine 402, the check-in computer 408, and the event server 404 to provide for game play while waiting in a queue for entry into an event and the awarding of prizes won based on the game play. In this example, a pager issued by event personnel is integrated into the communications to enable the game play and prize awarding. Also, the game play occurs at a wagering game machine. The check-in computer 408 transmits a communication A 430 to the pager 410. Event personnel can provide the pager 410 to the person at the check-in counter when the person is placed in the queue. At this point, the person is within a queue for entry into an event. The communication A 430 can indicate that there is placement in the queue. For example, event personnel can input the placement into an input of the check-in computer 408 at a check-in counter for an event (see FIG. 1). In response, the check-in computer 408 can transmit the communication A 430 to the pager 410 to indicate placement in the queue.

The pager 410 can then transmit a communication B 432 to the wagering game machine 402. The communication B 432 can indicate placement in the queue. The person can then play a game at the wagering game machine 402, while waiting for entry into the event. During game play, the person can be awarded different prizes. Identification of these prizes can be stored in machine-readable media. In some example embodiments, these prizes are not given to the person until after they check-in to the event and/or actually complete attending the event.

At some later time, the person is notified that they are now allowed entry into the event. This can be through verbal communication by event personnel, a communication transmitted from the check-in computer 408 to the pager 410 or the wagering game machine 402, etc. The person then returns to the check-in counter. Also in response to ending game play, the wagering game machine 402 can transmit a communication C 434 to the pager 410. The communication C 434 can include identification of prizes won during game play.

Once the person returns to the check-in counter, the pager 410 can transmit a communication D 436 back to the check-in computer 408. The communication D 436 can be initiated based on a request for information by the check-in computer 408 after event personnel inputs to the check-in computer 408 that the person is checked in. In response, the pager 410 can transmit the communication D 436 that can include identification of prizes won during game play and confirmation of check-in.

After check-in of the person, the prizes can be awarded to the person. In some example embodiments, this awarding of the prizes is performed based on a communication E 438 being transmitted from the check-in computer 408 to the event server 404. The communication E 438 can include identification of the person, prizes won, and an indication that a check-in has occurred. The server event module in the event server 404 can process the communication E 438. For example, the server event module can update loyalty points for a player account for the person; issue a coupon (e.g., 10%) related to the event, etc. The coupon can be electronically issued to an account associated with the person or a physical ticket can be output and presented to the person.

Another example of communications while waiting in a queue for entry into an event which includes both a mobile device and a group of wagering game machines is now described. In this example, a wagering game player desires to play one of a group of wagering game machines that are currently occupied by other wagering game players. Accordingly, in this example the event includes game play of one of a group of wagering game machines. Also, in this example no check-in computer is needed. Rather, a request to play the next available wagering game machine is based on communications between a person's mobile device and one of the wagering game machines. Also, in this example, the person that is waiting may or may not play a game (as described above) while waiting on the queue for the next available wagering game machine. In particular, FIG. 5 depicts communications between a mobile device and a group of wagering game machines (currently occupied by others) for play of one of the wagering game machines, according to some example embodiments.

FIG. 5 includes a group of wagering game machines. For example, the group of wagering game machines can be part of a same bank that is based on community gaming, progressive jackpots, etc. The group of wagering game machines includes a wagering game machine 512, a wagering game machine 514, a wagering game machine 516, and a wagering game machine 518, which are communicatively coupled together (wired communication or wireless communication). All the wagering game machines are currently occupied by wagering game players. A wagering game player 504 is playing a wagering game on the wagering game machine 512. A wagering game player 506 is playing a wagering game on the wagering game machine 514. A wagering game player 508 is playing a wagering game on the wagering game machine 516. A wagering game player 510 is playing a wagering game on the wagering game machine 518.

A person 502 having their mobile device 544 wants to play on one of the wagering game machines 512-518. The mobile device 544 can set up a communication with one of the wagering game machines. In this example, the mobile device 544 establishes communication with the wagering game machine 512. For example, the person can initiate an application on their mobile device 544 to establish communications with wagering game machines that are within a certain communication range (e.g., NFC, Bluetooth, etc.). The application on the mobile device 544 can enable the person to request placement into the queue for allowing them to play the next available wagering game machine within the group of wagering game machines. This request is shown as a communication A 520.

In response, the wagering game machine 512 updates a queue for the group of wagering game machines. This queue can be stored in a non-volatile machine-readable media within one, some or all of the wagering game machines. In particular, the wagering game machine 512 may communicate with the other wagering game machines (514-518) to update the queue. The communication A 520 can include the wagering account username and password to enter the queue. Once a wagering game machine becomes available, the person is given a window of opportunity to play the wagering game machine. In some example embodiments, the person 502 is notified about the availability and the time frame of the window of opportunity (e.g., 2 minutes) based on a communication with the mobile device 544. In some example embodiments, the person 502 is provided an opportunity to play a game on the mobile device 544 (as described above) while waiting in the queue. The person is then awarded these prizes once they begin play at one of the wagering game machines 512-518. For example, after game play is complete on their mobile device 544, the mobile device 544 transmits the identification of prizes to the wagering game machine that the person 502 is to play. In some example embodiments, the prizes relate to game play at the wagering game machines 512-518. For example, the prizes can include unlocked content, increased multipliers, etc. These prizes may only be valid during this game play session at the wagering game machines 512-518, for a limited time during this game play session at the wagering game machines 512-518, at later game play session for the wagering game machines 512-518, at later game play sessions for wagering game machines having a same them but in the same wagering game establishment, etc.

Example Operations

This section describes operations associated with some example embodiments. In the discussion below, the flow charts will be described with reference to the block diagrams presented above. However, in some example embodiments, the operations can be performed by logic not described in the block diagrams.

In certain embodiments, the operations can be performed by executing instructions residing on machine-readable media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform less than all the operations shown in any flow diagram.

Figure 6:
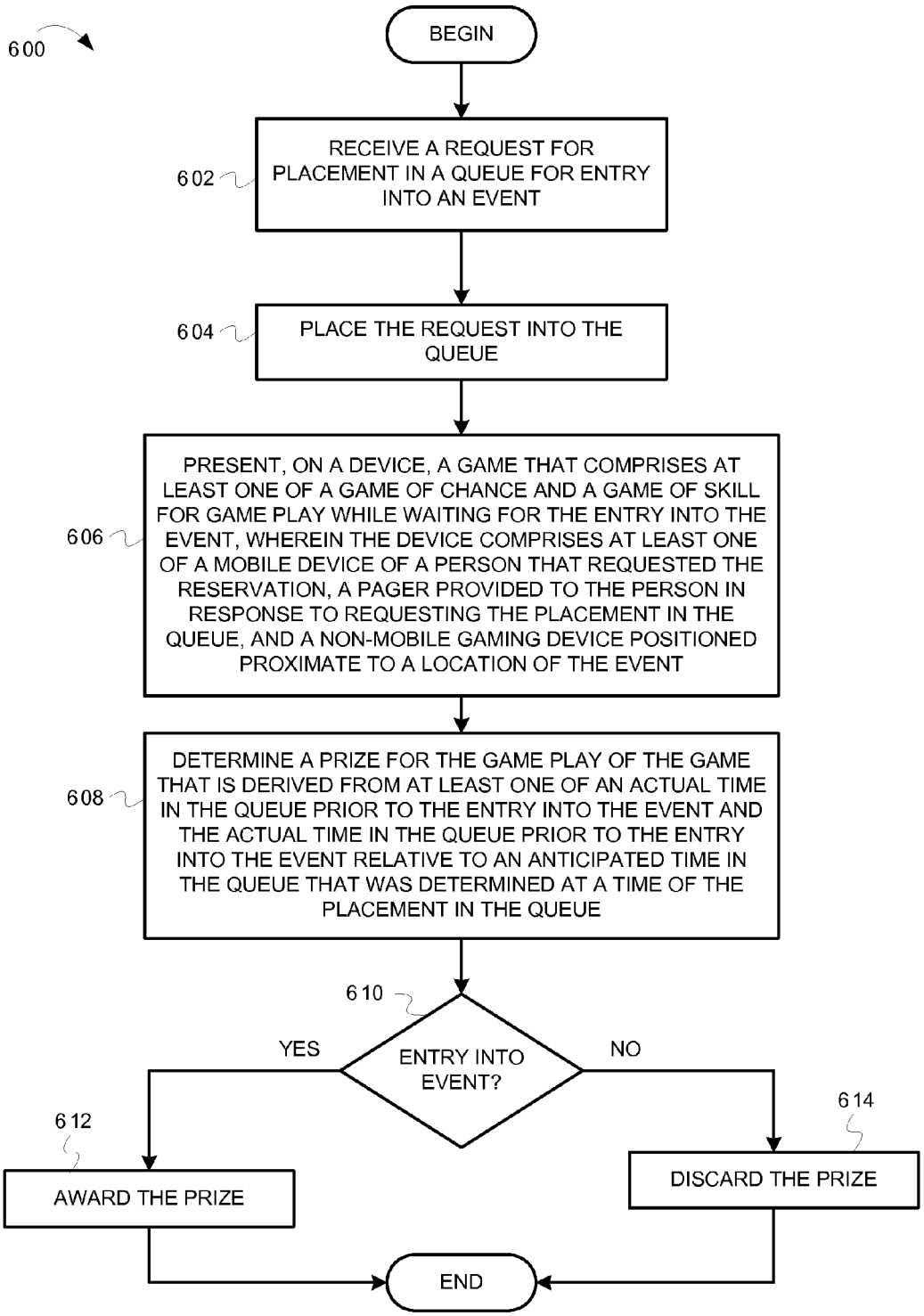
FIG. 6 depicts a flowchart for game play while waiting in a queue for entry into an event, according to some example embodiments.
Figure 7:
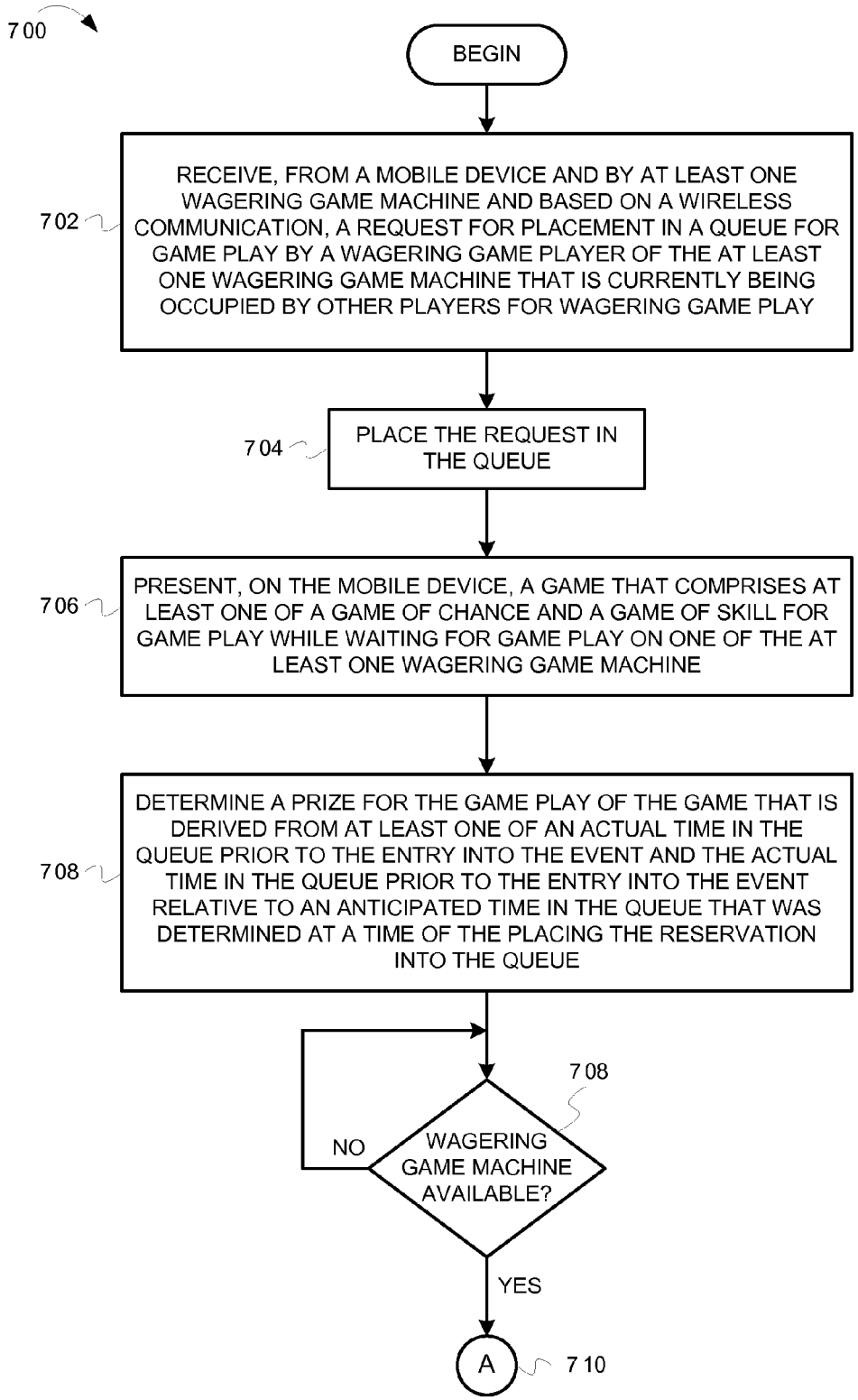
FIGS. 7-8 depict flowcharts for game play while waiting in a queue for playing one of a group of wagering game machines that are currently occupied, according to some example embodiments.
Figure 8:
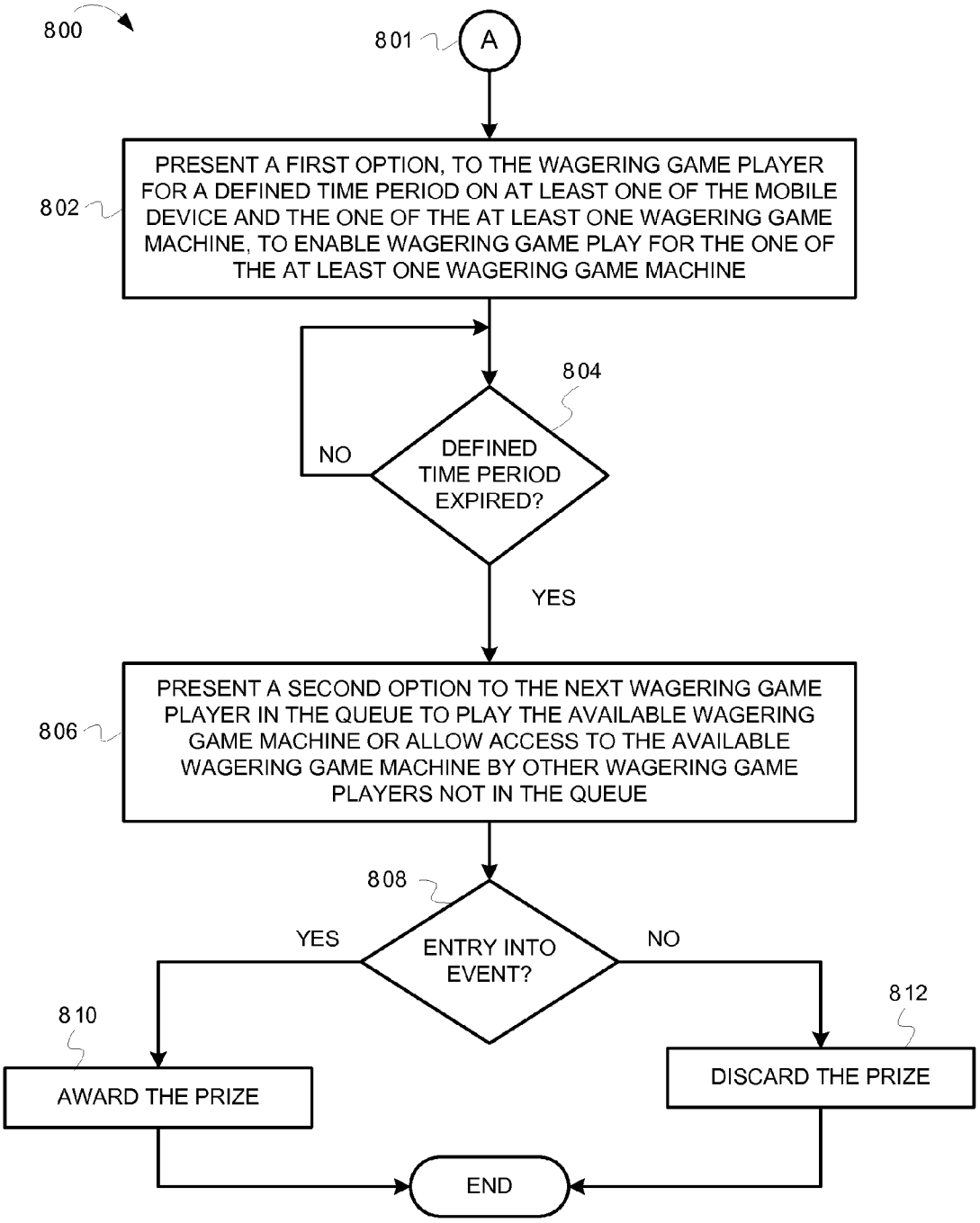

The section will discuss FIGS. 6-8. The discussion of FIGS. 6-8 will describe operations for game play while waiting in a queue for entry into an event. In particular, FIG. 6 depicts a flow chart for game play while waiting in a queue for entry into an event. FIGS. 7-8 depict flow charts for a specific application, wherein the event is game play of one of a group of wagering game machines. The flowchart of FIG. 8 is a continuation of the flowchart of FIG. 7.

FIG. 6 depicts a flowchart for game play while waiting in a queue for entry into an event, according to some example embodiments. The operations of a flowchart 600 are described in reference to FIG. 1. The operations of the flowchart 600 begin at block 602.

At block 602, the check-in computer 108 receives a request for placement in a queue for entry into an event. For example with reference to FIG. 1, event personnel 114 can input the request to the check-in computer 108 based on the person 116 being placed in the queue. In some example embodiments, the check-in computer 108 can receive the request through a communication of the mobile device of the person. Operations of the flowchart 600 continue at block 604.

At block 604, the check-in computer 108 places the request in the queue. With reference to FIG. 1, the check-in computer 108 stores the request in a queue that is stored in a nonvolatile machine-readable media (either local or remote to the check-in computer 108). Operations of the flowchart 600 continue at block 606.

At block 606, a game is presented, on a device to the person that made the request, while waiting for the entry into the event. The device can include at least one of a mobile device owned a person that requested the placement into the queue; a pager provided to the person in response to requesting placement in the queue; and a non-mobile gaming device (e.g., a wagering game machine) positioned proximate to a location of the event. The game can include at least one of a game of chance and a game of skill for game play. With reference to FIG. 1, one of the mobile devices, one of the pager or one of the non-mobile gaming devices can present the game. Operations of the flowchart 600 continue at block 608.

At block 608, a prize is determined for the game play of the game that is derived from at least one of an actual time in the queue prior to the entry into the event and the actual time in the queue prior to the entry into the event relative to an anticipated time in the queue that was determined at a time of the placement in the queue. With reference to FIG. 1, the device presenting the game can also determine the prizes awarded for winning results. Operations of the flowchart 600 continue at block 610.

At block 610, the check-in computer 108 determines whether the person entered the event. With reference to FIG. 1, after the person is notified that it is their time to enter the event, the check-in computer 108 receives an indication that the person has return to enter the event. This indication can be received from input by event personnel that inputs after the person returns; from a communication of the pager or mobile device; etc. If the event is entered by the person that made the request, operations of the flowchart 600 continue at block 612. Otherwise, operations of the flowchart 600 continue at block 614.

At block 612, the check-in computer 108 awards the prize won during game play. For example with reference to FIG. 1, the check-in computer 108 can transmit a communication to the event server 104 (see example of FIG. 2); provide redemption of the prize directly to the person (e.g., physical coupon); transmit a communication to the person's mobile device that can be used for subsequent redemption of the prize. Operations of the flowchart 600 are complete.

At block 614, the check-in computer 108 discards the prize won during game play. With reference to FIG. 1, after a given time period, the next person in the queue is allowed entry into the event. Accordingly, after expiration of this given time period, the check-in computer 108 effectively discards the prize (not allowing the person to subsequently award). Operations of the flowchart 600 are complete.

FIGS. 7-8 depict flowcharts for game play while waiting in a queue for playing one of a group of wagering game machines that are currently occupied, according to some example embodiments. The operations of a flowchart 700 and 800 are described in reference to FIG. 5. The operations of the flowchart 700 are first described and followed by a description of the operations of the flowchart 800 (which are a continuation of the operations of the flowchart 700). The operations of the flowchart 700 begin at block 702.

At block 702, a wagering game machine receives, from a mobile device and based on a wireless communication, a request for placement in a queue for game play by a wagering game player of the at least one wagering game machine that is currently being occupied by other players for wagering game play. For example with reference to FIG. 5, the wagering game machine 512 receives this request. Operations of the flowchart 700 continue at block 704.

At block 704, the wagering game machine places the request in the queue. For example with reference to FIG. 5, the wagering game machine 512 can store the request in a queue that is stored in nonvolatile machine-readable media locally; in nonvolatile machine-readable media in some or each of the other wagering game machines; in nonvolatile machine-readable media in a remote game server; etc. Operations of the flowchart 700 continue at block 706.

At block 706, a mobile device presents a game to the person that made the request, while waiting for availability of one of the wagering game machines. As described above, the game can include at least one of a game of chance and a game of skill for game play. With reference to FIG. 5, the mobile device 544 can present the game to the person 502. Operations of the flowchart 700 continue at block 708.

At block 708, the mobile device determines a prize for the game play of the game that is derived from at least one of an actual time in the queue prior to the entry into the event and the actual time in the queue prior to the entry into the event relative to an anticipated time in the queue that was determined at a time of the placement in the queue. With reference to FIG. 5, the mobile device 544 presenting the game can also determine the prizes awarded for winning results. Operations of the flowchart 700 continue at block 710.

At block 710, an operation is periodically executed at any point in the operations in the flowchart 700 to determine whether any of the wagering game machines are available. Alternatively, a transmission can be received by the wagering game machine that initially received placement in the queue. The transmission can be from any of the other wagering game machines that indicate their availability. If a wagering game machine is not available, operations of the flowchart 700 continue to wait. Otherwise, operations of the flowchart 700 continue at continuation point A 712, which continues at continuation point A 801 of the flowchart 800, which is now described.

From continuation point A 801, operations of the flowchart 800 start at block 802. At block 802, a first option is presented to a wagering game player for a defined time period to enable wagering game play on the available wagering game machine. For example with reference to FIG. 5, the available wagering game machine can send a wireless transmission to the mobile device 544. If the person 502 with the mobile device 544 is in communication range, a notification can be presented on the mobile device 544 (e.g., a pop-up window on a display) that indicates that the wagering game machine is available for their use for the defined time period. Alternatively or in addition, the available wagering game machine can provide some indication to the person 502 such as audio or visual notification (e.g., a pop-up window on a display that includes the name of the person of the defined time period). Operations of the flowchart 800 continue at block 804.

At block 804, the available wagering game machine determines whether the defined time period has expired. If the defined time period has not expired, the available wagering game machine continues to wait. Otherwise, operations of the flowchart 800 continue at block 806.

At block 806, a second option is presented to the next wagering game player in the queue to enable wagering game play on the available wagering game machine. For example, the available wagering game machine can send a wireless transmission to the mobile device of the next wagering game player in the queue. If this player with their mobile device is in communication range, a notification can be presented on their mobile device (e.g., a pop-up window on a display) that indicates that the wagering game machine is available for their use for the defined time period. Alternatively or in addition, the available wagering game machine can provide some indication to the player such as audio or visual notification (e.g., a pop-up window on a display that includes the name of the person of the defined time period). Alternatively, the available wagering game machine can be made available for wagering game play by other wagering game players that are waiting but not in the queue. For example, if the queue is empty, any person can play the available wagering game machine. Operations of the flowchart 800 continue at block 808.

At block 808, the available wagering game machine also determines whether entry of the event was made by the wagering game player that was presented the first option. With reference to FIG. 5, after the person 502 commences play at the available wagering game machine, entry into the event is considered to have occurred. If there is not entry of the event by the wagering game player, operations of the flowchart 800 continue at block 810. Otherwise, operations of the flowchart 800 continue at block 812.

At block 810, the available wagering game machine awards the prize won during game play on their mobile device. For example, if the prize relates to the wagering game play at the available wagering game machine, the prize is provided to the person at the machine. For example, the available wagering game machine can issue game credits, unlock content, etc. The prizes are not limited to the play at the available wagering game machine. For example, the person's account can be credit with coupons, rewards, etc. based on the prizes won during game play at their mobile devices while waiting in the queue. Operations of the flowchart 800 are complete.

At block 812, the prize won during game play are discarded. In particular, the prizes cannot be awarded after the defined time period is expired (see block 804 described above). Accordingly, after expiration of this given time period, the mobile device effectively discards the prize (not allowing the person to subsequently award). Operations of the flowchart 800 are complete.

Wagering Game Machine Architecture

Figure 9:
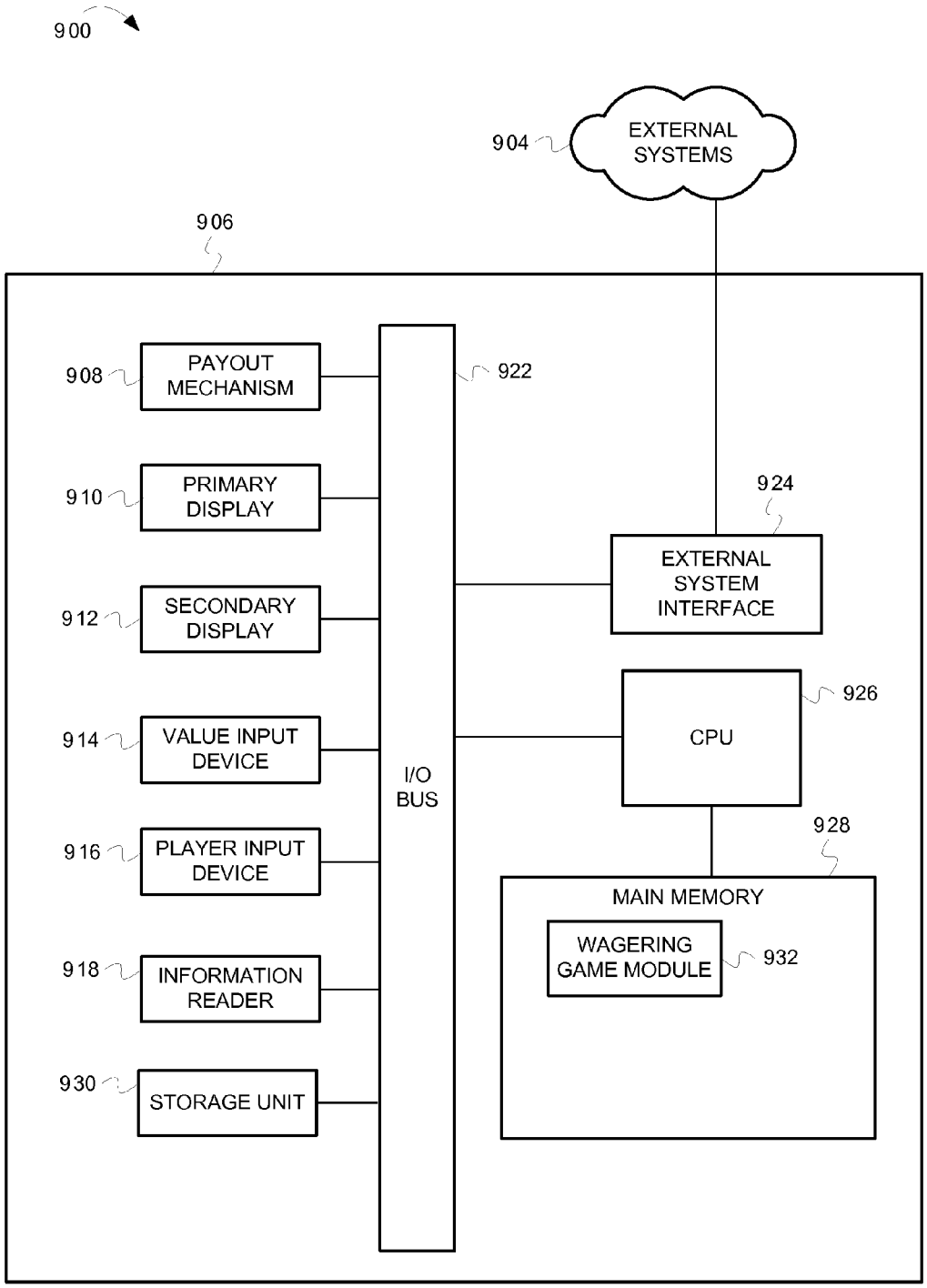
FIG. 9 depicts a block diagram illustrating a wagering game machine architecture, according to some example embodiments.

This section describes an example wagering game architecture. FIG. 9 depicts a block diagram illustrating a wagering game machine architecture, according to some example embodiments. As shown in FIG. 9, the wagering game machine architecture 900 includes a wagering game machine 906, which includes a central processing unit (CPU) 926 connected to main memory 928. The CPU 926 can include any suitable processor, such as an Intel® Pentium processor, Intel® Core 2 Duo processor, AMD Opteron™ processor, or UltraSPARC processor. The main memory 928 includes a wagering game module 932. In one embodiment, the wagering game unit 932 can present wagering games, such as video poker, video black jack, video slots, video lottery, etc., in whole or part.

The CPU 926 is also connected to an input/output (I/O) bus 922, which can include any suitable bus technologies, such as an AGTL++ frontside bus and a PCI backside bus. The I/O bus 922 is connected to a payout mechanism 908, primary display 910, secondary display 912, value input device 914, player input device 916, information reader 918, and storage unit 930. The player input device 916 can include the value input device 914 to the extent the player input device 916 is used to place wagers. The I/O bus 922 is also connected to an external system interface 924, which is connected to external systems 904 (e.g., wagering game networks).

In one embodiment, the wagering game machine 906 can include additional peripheral devices and/or more than one of each component shown in FIG. 9. For example, in one embodiment, the wagering game machine 906 can include multiple external system interfaces 924 and/or multiple CPUs 926. In one embodiment, any of the components can be integrated or subdivided.

Any component of the architecture 900 can include hardware, firmware, and/or machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Example Wagering Game Machine

Figure 10:
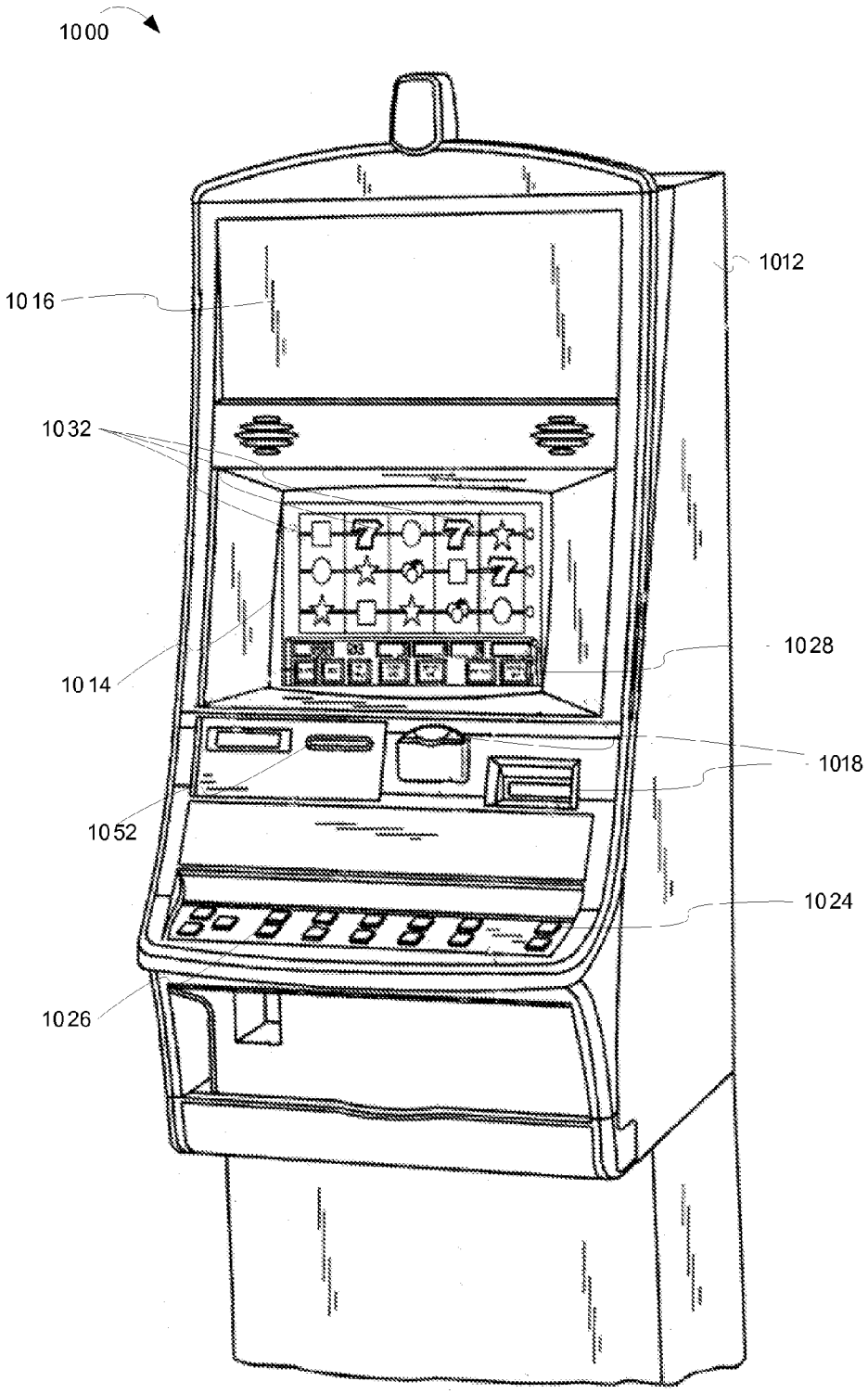
FIG. 10 depicts a perspective view of a wagering game machine, according to some example embodiments.

FIG. 10 depicts a perspective view of a wagering game machine, according to some example embodiments. Referring to FIG. 10, a wagering game machine 1000 is used in gaming establishments, such as casinos. According to embodiments, the wagering game machine 1000 can be any type of wagering game machine and can have varying structures and methods of operation. For example, the wagering game machine 1000 can be an electromechanical wagering game machine configured to play mechanical slots, or it can be an electronic wagering game machine configured to play video casino games, such as blackjack, slots, keno, poker, blackjack, roulette, etc.

The wagering game machine 1000 comprises a housing 1012 and includes input devices, including value input devices 1018 and a player input device 1024. For output, the wagering game machine 1000 includes a primary display 1014 for displaying information about a basic wagering game. The primary display 1014 can also display information about a bonus wagering game and a progressive wagering game. The wagering game machine 1000 also includes a secondary display 1016 for displaying wagering game events, wagering game outcomes, and/or signage information. While some components of the wagering game machine 1000 are described herein, numerous other elements can exist and can be used in any number or combination to create varying forms of the wagering game machine 1000.

The value input devices 1018 can take any suitable form and can be located on the front of the housing 1012. The value input devices 1018 can receive currency and/or credits inserted by a player. The value input devices 1018 can include coin acceptors for receiving coin currency and bill acceptors for receiving paper currency. Furthermore, the value input devices 1018 can include ticket readers or barcode scanners for reading information stored on vouchers, cards, or other tangible portable storage devices. The vouchers or cards can authorize access to central accounts, which can transfer money to the wagering game machine 1000.

The player input device 1024 comprises a plurality of push buttons on a button panel 1026 for operating the wagering game machine 1000. In addition, or alternatively, the player input device 1024 can comprise a touch screen 1028 mounted over the primary display 1014 and/or secondary display 1016.

The various components of the wagering game machine 1000 can be connected directly to, or contained within, the housing 1012. Alternatively, some of the wagering game machine's components can be located outside of the housing 1012, while being communicatively coupled with the wagering game machine 1000 using any suitable wired or wireless communication technology.

The operation of the basic wagering game can be displayed to the player on the primary display 1014. The primary display 1014 can also display a bonus game associated with the basic wagering game. The primary display 1014 can include a cathode ray tube (CRT), a high resolution liquid crystal display (LCD), a plasma display, light emitting diodes (LEDs), or any other type of display suitable for use in the wagering game machine 1000. Alternatively, the primary display 1014 can include a number of mechanical reels to display the outcome. In FIG. 10, the wagering game machine 1000 is an "upright" version in which the primary display 1014 is oriented vertically relative to the player. Alternatively, the wagering game machine can be a "slant-top" version in which the primary display 1014 is slanted at about a thirty-degree angle toward the player of the wagering game machine 1000. In yet another embodiment, the wagering game machine 1000 can exhibit any suitable form factor, such as a free standing model, bartop model, mobile handheld model, or workstation console model.

A player begins playing a basic wagering game by making a wager via the value input device 1018. The player can initiate play by using the player input device's buttons or touch screen 1028. The basic game can include arranging a plurality of symbols along a payline 1032, which indicates one or more outcomes of the basic game. Such outcomes can be randomly selected in response to player input. At least one of the outcomes, which can include any variation or combination of symbols, can trigger a bonus game.

In some embodiments, the wagering game machine 1000 can also include an information reader 1052, which can include a card reader, ticket reader, bar code scanner, RFID transceiver, or computer readable storage medium interface. In some embodiments, the information reader 1052 can be used to award complimentary services, restore game assets, track player habits, etc.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims. Each of the embodiments described herein are contemplated as falling within the inventive subject matter, which is set forth in the following claims.

The invention claimed is:

1. A method comprising:

receiving, by at least one processor, a request for placement in a queue for entry into an event;

placing, by the at least one processor, the request into the queue;

in response to placement of the request into the queue, presenting, by the at least one processor on a device, a game for game play while waiting in the queue for the entry into the event, wherein the device comprises at least one of a mobile device, a pager provided in response to requesting the placement in the queue, and a non-mobile gaming device positioned proximate to a location of the event;

determining, by the at least one processor, a prize for the game play of the game;

determining, by the at least one processor, whether the event is entered;

in response to not entering the event, discarding, by the at least one processor, the prize; and in response to entering the event, awarding, by the at least one processor, the prize.

2. The method of claim 1, wherein the game play requires an opt-in election, wherein the method comprises:

in response to a winning result of the game play, reassigning, by the at least one processor, the placement to a better position in the queue in comparison to a current position based on a time of the placement in the queue; and in response to a losing result of the game play, reassigning, by the at least one processor, the placement to a worse position in the queue in comparison to the current position.

3. The method of claim 1, wherein the prize is related to the event and comprises at least one of an upgrade to an experience of the event, a free item provided during the event, and a discounted item provided during the event.

4. The method of claim 1, wherein the prize has a limited duration of use, the limitation duration comprising at least one of a completion of the event and a calendar day of when the event occurred.

5. The method of claim 1, wherein the prize comprises a dynamic prize that dynamically changes while in the queue, wherein the dynamic prize increases in value over time while in the queue.

6. The method of claim 1, wherein the prize comprises unlocked content for a wagering game.

7. A method comprising:

receiving, by at least one processor, a request for placement in a queue for entry into an event;

placing, by the at least one processor, the request into the queue;

in response to placement of the request into the queue, presenting, by the at least one processor on a device, a game for game play while in the queue waiting for the entry into the event, wherein the device comprises at least one of a mobile device, a pager provided in response to requesting the placement in the queue, and a non-mobile gaming device positioned proximate to a location of the event;

determining, by the at least one processor, at least one of an actual time in the queue prior to the entry into the event and the actual time in the queue prior to the entry into the event relative to an anticipated time in the queue that was determined at a time of the placing the request into the queue;

determining, by the at least one processor, a prize for the game play of the game that is derived from the at least one of the actual time in the queue prior to the entry into the event and the actual time in the queue prior to the entry into the event relative to the anticipated time in the queue that was determined at the time of the placing the request into the queue;

determining, by the at least one processor, whether the event is entered;

in response to not entering the event, discarding, by the at least one processor, the prize; and in response to entering the event, awarding, by the at least one processor, the prize.

8. The method of claim 7, wherein the event comprises a wagering event, wherein the game comprises a version of the wagering event.

9. The method of claim 7, wherein the prize is related to the event and comprises at least one of an upgrade to an experience of the event, a free item provided during the event, and a discounted item provided during the event.

10. The method of claim 7, wherein the prize has a limited duration of use, the limitation duration comprising at least one of a completion of the event and a calendar day of when the event occurred.

11. The method of claim 7, wherein the prize comprises a dynamic prize that dynamically changes while in the queue, wherein the dynamic prize increases in value over time while in the queue.

12. The method of claim 7, wherein the prize comprises unlocked content for a wagering game.

13. The method of claim 7, wherein a person making the request for the placement in the queue was in a previous queue for previous entry into the event at a previous time, wherein a previous prize was output to the person based on entering the event at the previous time, wherein the prize is greater than the previous prize.

14. One or more non-transitory machine-readable storage media including instructions which, when executed by one or more processors, cause the one or more processors to perform operations comprising:

receiving, by the one or more processors, a request for placement in a queue for entry into an event;

placing the request into the queue;

in response to placement of the request into the queue, presenting, on a device, a game for game play while waiting in the queue for the entry into the event, wherein the device comprises at least one of a mobile device, a pager provided in response to requesting the placement in the queue, and a non-mobile gaming device positioned proximate to a location of the event;

determining a prize for the game play of the game;

determining whether the event is entered;

in response to not entering the event, discarding the prize; and in response to entering the event, awarding the prize.

15. The one or more non-transitory machine-readable storage media of claim 14, wherein the game play requires an opt-in election, wherein the operations comprise:

in response to a winning result of the game play, reassigning the placement to a better position in the queue in comparison to a current position based on a time of the placement in the queue; and in response to a losing result of the game play, reassigning the placement to a worse position in the queue in comparison to the current position.

16. The one or more non-transitory machine-readable storage media of claim 14, wherein the prize is related to the event and comprises at least one of an upgrade to an experience of the event, a free item provided during the event, and a discounted item provided during the event.

17. The one or more non-transitory machine-readable storage media of claim 14, wherein the prize has a limited duration of use, the limitation duration comprising at least one of a completion of the event and a calendar day of when the event occurred.

18. The one or more non-transitory machine-readable storage media of claim 14, wherein the prize comprises a dynamic prize that dynamically changes while in the queue, wherein the dynamic prize increases in value over time while in the queue.

19. An apparatus comprising:

a processor; and a check-in module operable on the processor, the check-in module configured to:

receive a request for placement in a queue for entry into an event;

determine at least one of an actual time in the queue prior to the entry into the event and the actual time in the queue prior to the entry into the event relative to an anticipated time in the queue that was determined at a time of the placing the request into the queue;

place the request into the queue, wherein in response to placement of the request into the queue, a game is presented, on a device, the game for game play while waiting in the queue for the entry into the event, wherein the device comprises at least one of a mobile device, a pager provided in response to requesting the placement into the queue, and a non-mobile gaming device positioned proximate to a location of the event, wherein a prize is determined for the game play of the game that is derived from the at least one of the actual time in the queue prior to the entry into the event and the actual time in the queue prior to the entry into the event relative to the anticipated time in the queue that was determined at the time of the placement into the queue;

determine whether the event is entered;

in response to not entering the event, discard the prize; and in response to entering the event, award the prize.

20. The apparatus of claim 19, wherein the prize has a limited duration of use, the limitation duration comprising at least one of a completion of the event and a calendar day of when the event occurred.

21. The apparatus of claim 19, wherein the prize comprises a dynamic prize that dynamically changes while in the queue, wherein the dynamic prize increases in value over time while in the queue.

22. One or more non-transitory machine-readable storage media including instructions which, when executed by one or more processors, cause the one or more processors to perform operations comprising:

receiving a request for placement in a queue for entry into an event;

placing the request into the queue;

in response to placement of the request into the queue, presenting, on a device, a game for game play while waiting in the queue for the entry into the event, wherein the device comprises at least one of a mobile device, a pager provided in response to requesting the placement in the queue, and a non-mobile gaming device positioned proximate to a location of the event;

determining at least one of an actual time in the queue prior to the entry into the event and the actual time in the queue prior to the entry into the event relative to an anticipated time in the queue that was determined at a time of the placing the request into the queue;

determining a prize for the game play of the game that is derived from the at least one of the actual time in the queue prior to the entry into the event and the actual time in the queue prior to the entry into the event relative to the anticipated time in the queue that was determined at the time of the placing the request into the queue;

determining whether the event is entered;

in response to not entering the event, discarding the prize; and in response to entering the event, awarding the prize.

23. The one or more non-transitory machine-readable storage media of claim 22, wherein the event comprises a wagering event, wherein the game comprises a version of the wagering event.

24. The one or more non-transitory machine-readable storage media of claim 22, wherein the prize is related to the event and comprises at least one of an upgrade to an experience of the event, a free item provided during the event, and a discounted item provided during the event.

25. The one or more non-transitory machine-readable storage media of claim 22, wherein the prize has a limited duration of use, the limitation duration comprising at least one of a completion of the event and a calendar day of when the event occurred.

26. The one or more non-transitory machine-readable storage media of claim 22, wherein the prize comprises a dynamic prize that dynamically changes while in the queue, wherein the dynamic prize increases in value over time while in the queue.

27. The one or more non-transitory machine-readable storage media of claim 22, wherein the prize comprises unlocked content for a wagering game.

28. The one or more non-transitory machine-readable storage media of claim 22, wherein a person making the request for the placement in the queue was in a previous queue for previous entry into the event at a previous time, wherein a previous prize was output to the person based on entering the event at the previous time, wherein the prize is greater than the previous prize.

* * * * *